US005296662A

United States Patent [19]

Engdahl et al.

[11] Patent Number: 5,296,662

[45] Date of Patent: Mar. 22, 1994

[54] ELECTRIC SWITCHING DEVICE

[75] Inventors: Göran Engdahl, Täby; Gunnar Molund; Ingvar Niemi, both of Västerås, all of Sweden

[73] Assignee: Asea Brown Boveri AB, Västerås, Sweden

[21] Appl. No.: 895,369

[22] Filed: Jun. 9, 1992

[30] Foreign Application Priority Data

Jun. 14, 1991 [SE] Sweden ..... 9101831-7

[51] Int. Cl.[5] ..... H01H 33/70

[52] U.S. Cl. ..... 200/150 R; 200/82 B; 200/144 AP

[58] Field of Search ..... 200/82 R, 82 E, 144 AP, 200/82 B, 148 F, 148 B, 150 R, 150 B, 150 D

[56] References Cited

U.S. PATENT DOCUMENTS 3,823,286 7/1974 Thurk et al. ..... 200/82 B 4,306,263 12/1981 Gray et al. ..... 200/144 APX

*Primary Examiner*—J. R. Scott

*Attorney, Agent, or Firm*—Watson, Cole, Grindle & Watson

[57] ABSTRACT

An electric switching device according to the invention comprises two fixed contacts and one movable contact, referred to jointly as the main contact system. The main contact system is located in an oil-insulated cavity enclosed in a housing. In its direction of movement, the movable contact has an extension in the form of a shaft. The shaft is formed with a hydraulic piston by which the movable contact is operated. The hydraulic piston is surrounded by a cavity in which a piston cavity is formed on each side of the hydraulic piston. The piston cavities are oil-filled. The movement of the shaft is determined by an electrically controlled directional valve. The directional valve receives signals as to whether the electric switching device is to be opened or closed. At a given signal, the directional valve distributes a high pressure to the piston cavity that is to be enlarged. The electric switching device can be provided with an auxiliary contact mechanism which can be placed either in the fixed contacts and/or in the movable contact. The electric switching device is provided with a bistable mechanism comprising wedge-shaped pistons biased by means of springs. The wedge-shaped pistons, in case of drop-out of pressure, lock the movable contact in the existing position via the shaft.

10 Claims, 2 Drawing Sheets

ELECTRIC SWITCHING DEVICE

TECHNICAL FIELD

The prior art for controllable reactive power compensation of a.c. networks with the aid of thyristors entails power losses in the convertor of the network. To avoid these power losses, it would be desirable to have a fast electric switching device for bypassing the thyristors. The fast electric switching device should have a high operating endurance and a low operating energy to achieve a rapid, bounce-free and synchronizable electrical commutation of load currents to and from passive and/or active circuit components. The present invention comprises an electric switching device having these properties. Besides being used for controllable reactive power compensation, the electric switching device can also be used for discharge of capacitors, in current limiters and in fast-acting on-load tap changers. The invention may also be used as a part component in medium-voltage and high-voltage circuit breakers, in overload protective devices for electric machines and for large load objects, etc.

BACKGROUND ART, PROBLEMS

One problem is that conventional electric switching devices with electrical contacts in oil have a low contact opening speed. This is due, inter alia, to the fact that in connection with contact opening, hydraulic counter forces arise in the oil, which together with the other forces of inertia provide a relatively low initial contact opening speed.

Problems with welding arcs and other arcs in connection with contact opening also arise. In connection with reactive power compensation with the aid of thyristors, it is desirable that a sufficiently high voltage is built up across the contact point for the thyristors to be able to fire. To make possible a considerable operating endurance, it is important that moderate welding arcs or other arcs arise since otherwise these will rapidly erode the contact surfaces.

Modern circuit breakers, because of the current and voltage range in which they are operating, of necessity have large dimensions, which requires a relatively high operating energy which, in turn, limits the speed of action.

For use in applications mentioned under the heading "technical field" above, the available circuit breakers are overdimensioned primarily from the point of view of voltage. The $SF_6$ circuit breaker is the breaker which most closely corresponds to the present invention. The $SF_6$ circuit breaker is designed to manage voltages approximately 10 times higher than what is necessary for these applications. Characteristic data for the $SF_6$ circuit breaker show that it can be operated up to 150 times at 10 kA and if the current increases to 60 kA, it manages about 15 operations. The problems with welding and other arcs are here overcome by the $SF_6$ gas blowing out the arc arising upon contact opening. As will be clear from the stated data, the operating endurance is not very high, nor is the operating speed.

Other circuits breakers available are vacuum circuit breakers and oil-minimum circuit breakers. However, for the intended applications of the electric switching device, neither the operating endurance, nor the operating speed of these breakers is sufficient, while at the same time their required operating energies are too large.

SUMMARY OF THE PRINCIPLE OF THE INVENTION, ADVANTAGES

The present invention relates to an electric switching device which is able to break and make an electric circuit at a high speed. The switching device is intended to be used for opening and/or closing operations with demands on a high operating endurance and a low operating energy in connection with rapid, bounce-free and synchronizable commutation of load currents to or example, power semiconductors.

The electric switching device comprises two fixed contacts and one movable contact, jointly referred to as the main contact system. The two fixed contacts are advantageously designed as circular-cylindrical bodies which, at one end, are plane-bevelled in relation to their center axes. The bevelled contact surfaces are placed opposite to each other in such a way that their planes form a wedge-shaped volume. The movable contact is wedge-shaped with a corresponding wedge angle and located in such a way that it is exactly adapted to be inserted between the contact surfaces of the fixed contacts.

In its direction of movement, the movable contact has an extension in the form of a shaft. The shaft is formed with a double-acting hydraulic piston with the aid of which it is operated. The electric switching device is surrounded by a housing which, at the hydraulic piston, is formed such that a piston cavity is created on each side of the opposite piston surfaces of the hydraulic piston.

That end of the shaft which consists of the movable contact is placed in a first cavity together with the fixed contacts. The other end of the shaft is placed in a second cavity. The first and second cavities are interconnected via a contact cavity channel and together constitute a common cavity, referred to as the contact cavity, which thus surrounds the two ends of the shaft. Both the contact cavity and the piston cavities are filled with oil.

The necessary contact force is maintained hydraulically by high and low static pressure, respectively, in the piston cavities acting on the opposite piston surfaces of the hydraulic piston. An electrically controlled directional valve alternates the high and low pressure, respectively, between the two sides of the double-acting hydraulic piston. Which pressure prevails on the respective side of the hydraulic piston is determined by whether the electric switching device is to be opened or closed. If, for example, the electric switching device is to be opened, a high pressure will prevail in the piston cavity which is nearest the main contact system. To avoid cavitation problems at contact surfaces and to suppress any arcing problems, the oil pressure in the contact cavity is equal to the high pressure which always prevails in one of the two piston cavities.

Thyristors in, for example, plants for fast controllable reactive power compensation are connected in parallel with the electric switching device. To make possible a fast contact opening and to enable the thyristors to fire without welding and arcing problems occurring, the electric switching device may be provided with an auxiliary contact mechanism which acts with a time lag during both opening and closing of the switching device.

The auxiliary contact mechanism allows a voltage to be built up and maintained during the first part of the opening stage of the main contact mechanism, allowing the thyristors to be fired without problems This auxiliary contact mechanism may either be included in the fixed contacts and/or in the movable contact.

Provided that the auxiliary contact mechanism is arranged in the movable contact, the following applies:

The auxiliary contact mechanism comprises two spring-biased contact pins which open out into the respective contact surfaces of the movable contact. The contact pins, each of which is running in a cylinder, are mechanically and electrically connected to each other by a ring, the symmetry axis of which corresponds to the axis of the movable contact. The contact pins with the associated ring constitute a so-called opening resistance.

When the electric switching device is to be opened, that is, when the wedge-shaped part of the movable contact starts moving away from the fixed contacts, the fixed contacts will be connected to each other, during the first stage of the movement, via the contact pins with the associated ring. This causes current to flow through the opening resistance. A certain voltage is built up across the fixed contacts and across the circuit component to which commutation of the load current is desired, for example a thyristor valve. Since the thyristors in a thyristor valve are already provided with firing pulses, they will start carrying current when the voltage across the fixed contacts have become sufficiently high. The current becomes sufficiently high in connection with the separation of the contact pins from the fixed contacts.

The principle is the same if the auxiliary contact mechanism is instead arranged in the fixed contact or simultaneously in both the fixed contacts and in the movable contact.

The electric switching device is provided with a first and a second bistability mechanism, the duty of which is to lock the movable contact in the existing position in case of loss of pressure.

Since the contact pins are provided with a continuous axial hole and since, among other things, they are controlled by means of pins centrally located in the hole, upon separation of the contact pins from the fixed contacts a jet of oil will be directed towards the region where a possible arc will arise. This, in conjunction with a high contact separation speed and the pressurized oil in the contact cavity, contributes to the suppression of the annoying arcing problems.

The most important difference between the $SF_6$ circuit breaker and the electric switching device is that in the $SF_6$ circuit breaker an arc arises which is to be extinguished, whereas in the switching device a stationary arc is never allowed to arise.

The advantages of the electric switching device according to the invention, which have manifested themselves through testing, are that it has low operating energy, in the order of magnitude of 10 J and that it has a high operating endurance since, with an acceptably small resultant contact wear, it can be operated up to the order of magnitude of 100,000 times at 150–200 A. The switching device can be operated vary fast and with a small variation in operating time. The actual current commutation takes place in times of the order of magnitude of $<70$ ms depending on the inductance in the circuit to which the commutation is performed. The very high operating endurance of the switching device is due, among other things, to the fact that all impacts take place via a protective oil film.

BRIEF DESCRIPTION OF THE DRAWINGS

The invention will be described in greater detail with reference to the accompanying drawings, wherein.

DETAILED DESCRIPTION OF THE INVENTION

Figure 1:
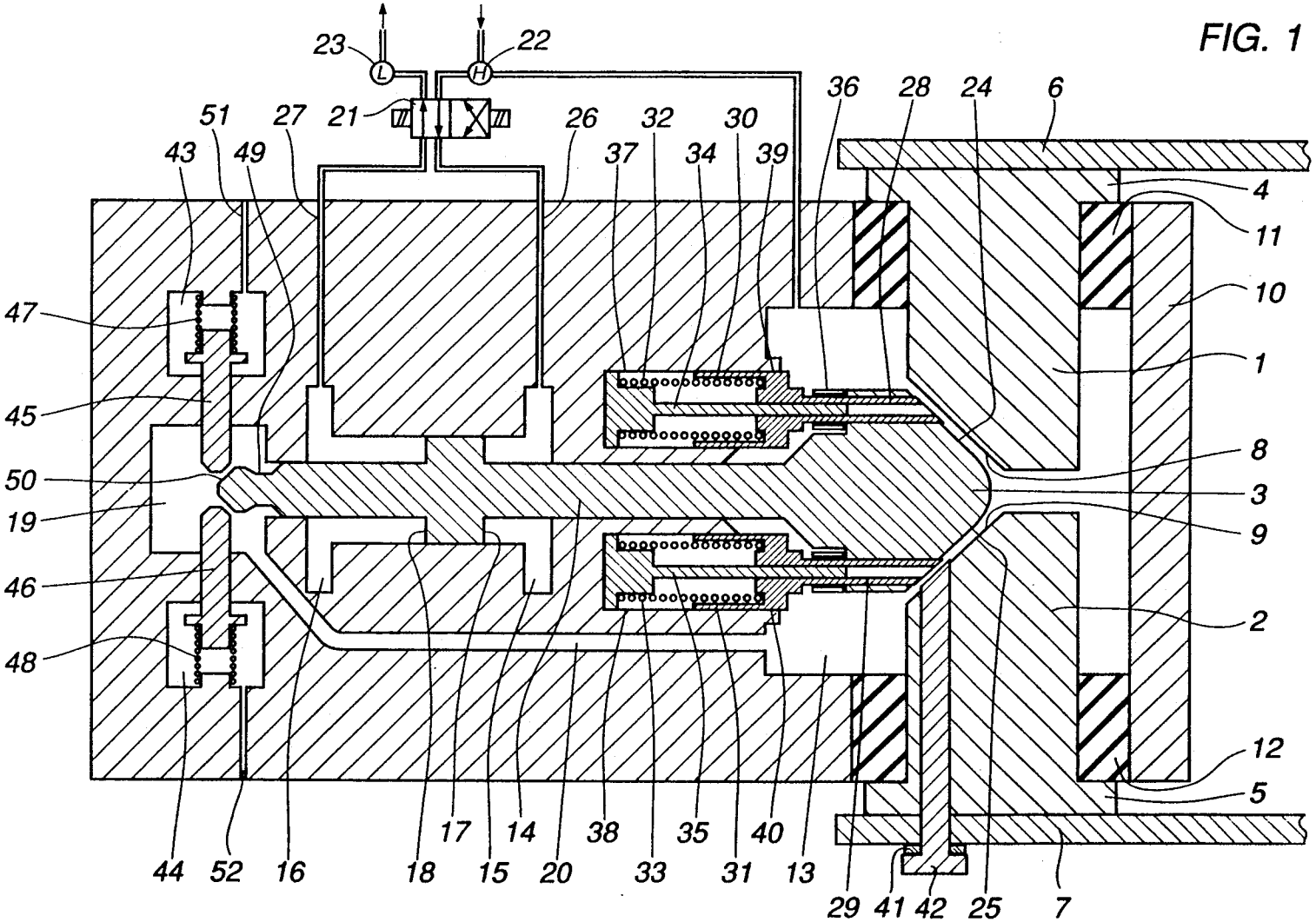
FIG. 1 is a view showing the principle of the electric switching device at the opening stage.

The electric switching device, according to FIG. 1, comprises two fixed contacts 1, 2 and a movable contact 3, jointly referred to as the main contact system. The fixed contacts 1, 2 are preferably designed as circular-cylindrical bodies, one end of the bodies being plane-bevelled relative to the center axes thereof and the other end of the bodies being formed as circular flanges 4, 5. An external current-carrying busbar system 6, 7 is connected to these flanges 4, 5.

In a housing 10 of steel, holes for the insertion of the fixed contacts 1, 2 are provided, these holes being provided with an insulation 11, 12. A first cavity 13, which surrounds the main contact system is arranged in the housing 10. The bevelled fixed contact surfaces 8, 9 are placed right opposite to each other in the first cavity 13 in such a way that their planes form a wedge-shaped volume. The axial length of the fixed contacts 1, 2 as well as their fixation in the housing 10 are adapted such that they converge centrically, in a certain spaced relationship, in the first cavity 13 The first cavity 13 is dimensioned so as to obtain a sufficient insulation distance between the envelope surface of the fixed contact bodies and the envelope surface of the cavity 13. The distance between the envelope surfaces of the contact bodies and the envelope surface of the cavity 13 shall be so large as to prevent electric flashover between the contact bodies and the housing 10.

The movable contact 3 is inserted with its wedge-shaped tip into the first cavity 13. The center line of the movable contact 3 is directed towards the intersecting line between the planes of the bevelled contact surfaces 8, 9 of the fixed contacts, and is also directed towards the center axis of the fixed contacts 1, 2. The movable contact 3 is formed such that no unnecessary flow resistance occurs.

In its direction of movement, the movable contact 3 has an extension in the form of a shaft 14 with a first and a second end. The shaft 14 is designed with a double-acting hydraulic piston with the aid of which it is operated. The hydraulic piston is surrounded by a cavity in the housing 10 in which a piston cavity 15 and a second piston cavity 16 are formed on each side of the opposite piston surfaces 17, 18 of the hydraulic piston.

The first end of the shaft 14, which consists of the movable contact 3, is placed in the first cavity 13 in the housing 10 together with the fixed contacts 1, 2. The second end of the shaft 14 is placed in a second cavity 19 at the opposite end of the housing 10. The first cavity 13 and second cavity 19 are interconnected by means of a contact cavity channel 20 and together constitute a common cavity, in the following referred to as the contact cavity. The contact cavity and the piston cavities 15, 16 are oil-filled. The two ends of the shaft 14 are thus located in the contact cavity and designed such that their movement, corresponding to an open and closed contact position, does not entail any change of their displacement in the contact avity. This is accomplished by the oil flowing beween the first cavity 13 and second cavity 19 through the contact cavity channel 20.

The necessary contact force is maintained hydraulically by a high and a low static pressure, respectively, in the piston cavities 15, 16 acting on the opposite piston surfaces 17, 18 of the hydraulic piston. An electrically controlled directional valve 21 alternates, with the aid of a high-pressure accumulator 22 and a low-pressure accumulator 23, the high and the low pressure, respectively, between the 30 piston cavities 15, 16. The high-pressure and low-pressure accumulators 22, 23 are arranged near the piston cavities 15, 16, thus obtaining a high speed of operation. Which pressure prevails in the respective piston cavity 15, 16 is determined by whether the electric switching device is open 35 or closed. If, for example, the electric switching device is to be opened, the directional valve 21 is operated such that a high pressure is connected into the first piston cavity 15 which is located nearest the main contact system. To avoid cavitation problems at the contact surfaces 8, 9 of the fixed contacts 1,2 and the movable contact 3 and to suppress any arcing problems, the oil pressure in the contact cavity is equal to the, high pressure which constantly prevails in the high-pressure accumulator 22.

The electrically controlled directional valve 1 is connected to the piston cavities 15, 16 via a first channel 26 and a second channel 27 which connect the outside of the housing 10 to the respective piston cavity 15, 16. The high-pressure and low-pressure accumulators 22, 23 are connected to a hydraulic unit. The electrically controlled directional valve 21 receives an electrical signal which indicates whether the electric switching device is to be opened or closed. When the switching device, for example, is to be opened, the directional valve 21 will assume such a position that the oil, under high pressure, via the directional valve 21 will be passed to the first channel 26 which is connected to the first piston cavity 15. The shaft 14 will then be moved in a direction away from the main contact system and the other piston cavity 16 must be partially emptied of oil. The oil is then pressed, via the second channel 27 and the directional valve 21, out to the low-pressure accumulator 23.

Figure 2:
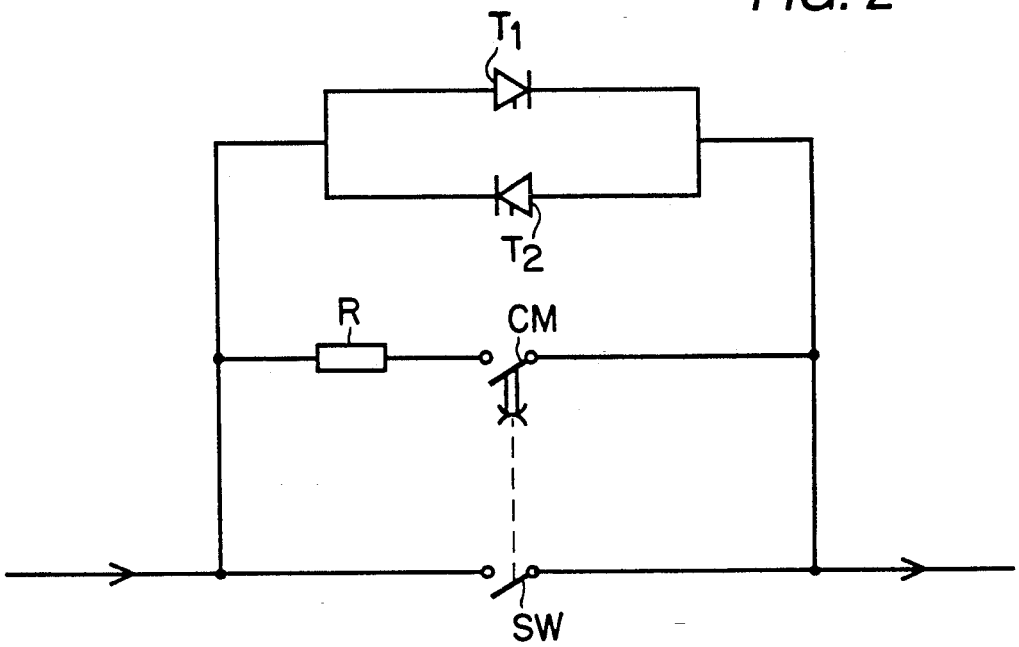
FIG. 2 illustrates, in principle, the electrical relationships between the main contact system, the auxiliary contact mechanism with time lag both during opening and closing, thyristors and opening resistance.

Thyristor $T_1$, $T_2$ in, for example, plants for fast controllable reactive power compensation are connected in parallel with electric switching device $S_w$. To make possible a fast contact opening and to enable the thyristors to fire without welding and other arcing problems occurring, the electric switching device $S_w$ may be provided with an auxiliary contact mechanism $C_m$ which acts with a time lag during both opening and closing. For an explanation of the electrical relationships, please see FIG. 2.

The auxiliary contact mechanism $C_m$ allows the voltage, required for the thyristors to fire, to be built up so rapidly that the thyristors fire without welding and arcing problems arising during the contact separation. This auxiliary contact mechanism may be included in the fixed contacts 1, 2 and/or in the movable contact 3.

Provided that the auxiliary contact mechanism is arranged in the movable contact, the following applies:

The auxiliary contact mechanism comprises two contact pins 28, 29, which are each formed with a piston 30, 31 and which are each provided with a spring 32, 33 and a pin 34, 35. The pins 34, 35 are centrally located in the respective contact pin 28, 29. The contact pins 28, 29 are interconnected by a ring 36, the symmetry axis of which corresponds to the shaft 14 of the movable contact 3. The resistance R in the contact pins 28, 29 with the associated ring 36 constitutes a so-called opening resistance.

The contact pins 28, 29 open out into the contact surfaces 24, 25 of the movable contact 3. The contact pins 28, 29 run 20 parallel to the shaft 14 and have ends which project from the contact surfaces 24, 25 of the movable contact and are situated in the active contact surfaces 8, 9, 24, 25. The contact pins 28, 29 run in cylinders 37, 38 with the aid of their pistons 30, 31 and springs 32, 33.

When the electric switching device assumes an open position, the contact pins 28, 29 are inside the cylinders 37, 38.

When the electric switching device is to be closed and the movable contact 3 operated towards the fixed contacts 1, 2, the movement of the contact pins 28, 29 will be delayed in relation to that of the movable contact 3. The throttle gaps 39, 40 which are provided between the contact pins 28, 29 and the cylinders 37, 38 are adapted such that the viscous braking forces on the contact pins 28, 29 counteract the forces from the springs 32, 33 such that the contact pins 28, 29 are not closed until the movable contact 3 reaches the two fixed contacts 1, 2.

When the throttle gaps 39, 40 are dimensioned in a suitable manner, the current has commutated over from the thyristors to the main contact system before the contact pins 28, 29 have been closed. This means that, upon contact make, the contact pins 28, 29 are caused gently to engage the fixed contacts 1, 2. The opening resistance is then switched in, in parallel with the main contact system, a short while after the movable contact 3 has reached the fixed contacts 1, 2. Since the opening resistance is greater by several orders of magnitude than the resistance of the main contact system when the electric switching device is closed, this means that the opening resistance only carries current in connection with contact openings.

When the electric switching device is to be opened, that is, when the wedge-shaped part of the movable contact 3 starts moving from the fixed contacts 1, 2, the fixed contacts 1, 2 during the first stage of the movement will be connected to each other via the contact pins 28, 29. The opening resistance of the contact pins 28, 29 thus short-circuits the electric switching device until the movable contact 3 pulls the contact pins 28, 29 along with it. When the movable contact 3 reaches the ring 36 in which the contact pins 28, 29 are attached, it has reached a high speed in relation to the speed at the initial stage. The separation between the contact pins 28, 29 and the fixed contacts 1, 2 thereby takes place very rapidly. The opening resistance is low but still greater by several orders of magnitude than the contact resistance of the main contact system in closed position.

Upon separation of the contact pins 28, 29 from the fixed contacts 1, 2, the pins 34, 35 located in the axial through-hole in the respective contact pins 28, 29 direct a jet of oil towards the region where an arc will possibly arise. This jet of oil contributes to the suppression of annoying arcing problems.

The principle is the same if the auxiliary contact mechanism is placed in the fixed contacts 1, 2 or if it is placed simultaneously both in the fixed contacts 1, 2 and the movable contact 3. When the auxiliary contact mechanism is arranged in the fixed contacts 1, 2, a wire of a conducing material runs between the respective contact pins 28, 29 and the respective external current-carrying busbars 6, 7. Together with the respective wire, the contact pins 28, 29 constitute the opening resistance.

The time lag during opening of the electric switching device is due to the fact that a certain time passes before the impact of the movable contact 3 against the ring 36. This impact, which means that the contact pins 28, 29 separate from the fixed contacts 1, 2 is thus delayed in relation to the situation when the movable contact 3 leaves the fixed contacts 1, 2.

The corresponding time lag when making contact is primarily due to dampening via the throttle gaps 39, 40, but also to damping via the oil in the contact cavity. The oil in the contact cavity damps the movement of the contact pins 28, 29 in towards, for example, the fixed contacts 1, 2 when the movable contact 3 already makes contact with the fixed contacts 1, 2.

By the time lag during opening of the electric switching device, a certain space of time flows between the point where the movable contact 3 leaves the fixed contacts 1, 2 and the point where the electric contact via the contact pins 28, 29 is completely broken. This means that a current pulse occurs in the contact pins 28, 29 during the space of time before the commutation to, for example, the thyristors is initiated. By the impact between the movable contact 3 and the ring 36, the commutation is performed very rapidly.

To increase the voltage which, during the opening, is built up across the electric switching device, a PTC (Positive Temperature Coefficient) resistor 41 can be connected in series with the opening resistance. At the beginning of the surge current the PTC resistor 41 is in a low-resistance state but during the following space of time it switches to a high-resistance state Provided that one of the fixed contacts 1, 2 is provided with a bushing 42, the PTC resistor 41 may, for example, be arranged between the current-carrying busbar 7 and the bushing 42. From FIG. 1 it is clear how a PTC resistor 41, for example in the form of a disc with a center hole, can be arranged physically in the electric switching device. Since at the beginning of a current pulse the PTC resistor 41 is in a low-resistance state, insignificant welding takes place on the bevelled fixed contact surfaces 8, 9 and when the commutation is almost finished before the contact is entirely broken, the electrical wear will be very small also on the contact pins 28, 29.

At the second end of the shaft 14 in the housing 10, there are a third cavity 43 and a fourth cavity 44 for inserting a first and a second bistable mechanism. The cavities 43, 44 are arranged diametrically and at right angles to the direction of movement of the shaft 14.

The first bistable mechanism is identical with the second bistable mechanism and its task is, in case of a pressure drop out, to lock the movable contact 3 in the existing position via the shaft 14. The first and second bistable mechanisms each comprise a piston with a wedge-shaped end, called wedge piston 45, 46, biased by means of a sprig 47, 48. The bistable mechanisms are movable perpendicular to the shaft 14 allowing the shaft to move freely between its end positions associated with an open and a closed electric switching device, respectively. During the normal function of the electric switching device the high oil pressure keeps the springs 47, 48 compressed. When for some reason the oil pressure disappears, the spring-biased wedge pistons 45, 46 lock the shaft 14 and hence also the movable contact 3 in the present position. If the electric switching device is in the open position, the wedge pistons 45, 46 are locked against the wedge-shaped grooves 49 of the shaft 14, and if the electric switching device is in the closed position, the wedge pistons 45, 46 are locked against the conical end 50 of the shaft 14.

The cavities 43, 44 are drained by channels 51, 52 which connect the respective cavities 43, 44 with atmospheric pressure.

We claim:

1. An electric switching device, comprising:

a housing;

a main contact assembly including two fixed contacts, each formed as a pin and positioned along a common center line axis and each said pin including a confronting plane surface directed to form a wedge-shaped opening, and one movable contact including two plane contact wedge-shaped surfaces conforming to the wedge-shaped opening each of said fixed contacts, said movable contact being movable between a closed position to close an electrical circuit, in which said two fixed contacts are connected, and an open position to open said electrical circuit, in which said two fixed contacts are disconnected, said main contact assembly being disposed in a first cavity in said housing;

a piston shaft axially movable along an axis perpendicular to said common center line axis, a first end of said shaft carrying said movable contact in said first cavity, a second end of said piston shaft positioned in a second cavity in said housing, said first cavity and second cavity being interconnected through a channel in said housing, said piston shaft carrying a piston with first and second piston cavities on each end thereof;

an auxiliary contact mechanism connected to said main contact assembly and including two movable hollow contact pins for closing and opening said electrical circuit later than the respective closing and opening of said electrical circuit by operation of said main contact assembly;

a hydraulic system interconnected with said first cavity and said second cavity for operating said movable contact mechanism and said auxiliary contact mechanism; and two bistable mechanisms disposed in said second cavity and including at least one piston biased by means of a spring for locking said piston shaft with said movable contact in said open and closed positions in which said movable contact is positioned with a pressure drop in the hydraulic system.

2. An electric switching device according to claim 1, wherein the hollow contact pins are galvanically interconnected to each other by a member, the contact pins and the member together constituting an opening resistance provides a predetermined voltage build-up.

3. An electric switching device according to claims 2, wherein a PTC resistor is arranged in series with the opening resistance for an increased voltage build-up before the contact pins separate from the fixed contacts.

4. An electric switching device according to claim 1, wherein the contact pins in the movable contact are galvanically interconnected to each other by a member, said contact pins and the member together constitute an opening resistance, and the respective contact pins in the fixed contacts are galvanically interconnected to the respective fixed contacts by a further member, said further member and said contact pins together constitute an opening resistance and the opening resistances provide a predetermined voltage build-up.

5. An electric switching device according to claim 4, wherein a PTC resistor is in series connection with said opening resistance for an increased voltage build-up before the contact pins separate from said fixed contacts.

6. An electric switching device according to claim 1, wherein said two bistable mechanisms each comprise wedge-shaped pistons biased by springs and kept at a distance from the second end of the piston shaft as long as the pressure in the hydraulic system exceeds a predetermined level.

7. An electric switching device according to claim 1, wherein said hydraulic system comprises said two piston cavities, said first and second cavities as well as an electrically controlled directional valve for operating the movable contact by providing high pressure oil to said first piston cavity nearest to said first end of said piston when the electric switching device is opening, and providing high pressure oil to the piston cavity nearest to the second end of said piston when closing the electric switching device.

8. An electric switching device according to claim 7, wherein said directional valve is arranged outside the housing and in close proximity to a high-pressure and a low-pressure accumulator outside the housing as well as in close proximity to the piston cavities.

9. An electric switching device according to claim 8, wherein said first and second cavities are interconnected and connected to said high pressure accumulator so that the oil pressure in said first and second cavities is equal to the high pressure prevailing in said high-pressure accumulator.

10. An electrical switching device according to claim 1, wherein said two movable hollow contact pins each partly surround a fixed piston and a hollow cylinder space in said housing, and said hollow cylinder space being filled with oil from said hydraulic system, wherein, with said contact pins drawn in a direction away from said fixed contacts, a jet of oil is ejected into an arcing region in said housing subsequent to the separation of said contact pins with the respective one of said fixed contacts for extinguishing any arcs generated in said arcing region by said separation.

* * * * *